United States Patent [19]

Monbaliu et al.

[11] 4,340,664

[45] Jul. 20, 1982

[54] COPOLYMER LATEX AND PHOTOGRAPHIC SILVER HALIDE MATERIALS CONTAINING SUCH LATEX

[75] Inventors: Marcel J. Monbaliu, Mortsel; Walter F. De Winter, 's-Gravenwezel; Raphaël K. Van Poucke, Berchem, all of Belgium

[73] Assignee: Agfa-Gevaert, N.V., Mortsel, Belgium

[21] Appl. No.: 188,734

[22] Filed: Sep. 19, 1980

[30] Foreign Application Priority Data

Oct. 15, 1979 [GB] United Kingdom ..... 7935782

[51] Int. Cl.[3] ..... G03C 5/24; G03C 1/40

[52] U.S. Cl. ..... 430/449; 430/461; 430/464; 430/505; 430/512; 430/548; 430/559; 430/931; 430/955; 430/957; 430/959; 430/960; 524/807; 524/809; 524/805; 524/813; 524/817

[58] Field of Search ..... 430/548, 487, 544, 561, 430/559, 512, 449, 464, 505; 260/29.6 TA, 29.6 H, 29.6 SQ, 29.6 HN

[56] References Cited

U.S. PATENT DOCUMENTS

| | | | |
|---|---|---|---|
| 3,356,686 | 12/1967 | Firestine et al. | 430/554 |
| 3,926,436 | 12/1975 | Monbaliu et al. | 430/548 |
| 4,080,211 | 3/1978 | Van Paesschen et al. | 430/548 |
| 4,128,427 | 12/1978 | Monbaliu et al. | 430/552 |

FOREIGN PATENT DOCUMENTS 1453057 10/1976 United Kingdom .

*Primary Examiner*—J. Travis Brown
*Attorney, Agent, or Firm*—A. W. Breiner

[57] ABSTRACT

Latexes suited for homogeneously incorporating compounds with a photographically useful group into photographic silver halide emulsion materials. The latex incorporates a copolymer comprising recurring units of a monomer with photographically useful group, and recurring units of surface active monomer, according to the general formula:

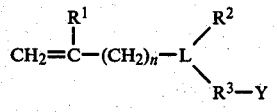

wherein:

$R^1$ is hydrogen or methyl, n is 0 or 1 to 20,

L is

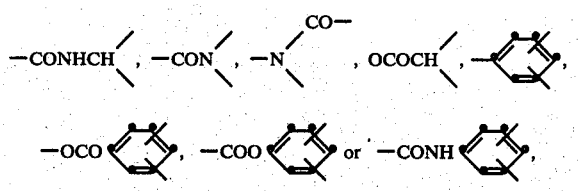

$R^2$ is hydrogen or a hydrocarbon group, $R^3$ is a monovalent chemical bond or a bivalent aliphatic hydrocarbon group or such group interrupted by the group —COO— or —CONR—, and Y is a sulpho, sulphato or phosphono group in acid or salt form, and at least one of the groups $-(CH_2)_n-$, $R^2$ and $R^3$ is or comprises a hydrocarbon chain of at least 8 C-atoms.

10 Claims, No Drawings

COPOLYMER LATEX AND PHOTOGRAPHIC SILVER HALIDE MATERIALS CONTAINING SUCH LATEX

The present invention relates to a latex of copolymer containing recurring units including a group useful in silver halide photography and recurring units including a strong hydrophilic group, and to photographic silver halide emulsion materials containing such latex.

The incorporation of substances that have to fulfil a role in providing or maintaining certain properties in photographic hydrophilic colloid binder silver halide materials is a problem that has been dealt with already in different ways. For example, for incorporating colour couplers, dispersion techniques have been applied wherein the coupler is dissolved in a water-immiscible solvent, a so-called oil-former, and the solution is dispersed in the form of fine droplets in the hydrophilic colloid medium of a photographic silver halide emulsion. Apart from the advantages of that technique the oily coupler solvents tend to soften the emulsion layer whereby it becomes less scratch-resistant.

In order to remedy for defects associated with the use of oil formers there has been provided a method of incorporating colour couplers in an aqueous colloid medium in the form of a latex i.e. as a chemically structural part of polymer particles that have been dispersed in aqueous medium. Such method has been described e.g. in the U.S. Pat. Nos. 2,976,294; 3,356,686; 3,767,412, and 4,128,427.

These latexes may contain a high percentage of polymer particles e.g. up to 50% by weight, and nevertheless still possess a relatively low viscosity. By the use of these latexes there can be dispensed with the use of organic solvents or alkaline solutions as well as with special dispersing techniques.

However, the use of latexes is not without problems of e.g. dispersion stability and may give rise to a lower activity of the photographically useful group since the latter is incorporated in the polymer structure of a dispersed particle. An improved dispersion stability can be obtained by incorporating an amount of emulsifying agent in the latex but such often at the expense of undesired foaming and the occurrence of coating defects of layers incorporating such latexes such as streaks and repellency spots.

These disadvantages may be avoided or reduced in particular by stabilizing the aqueous polymer dispersion with an internally chemically combined hydrophilic structural group as described e.g. in the U.S. Pat. No. 3,926,436. However, the hydrophilic monomers described in the latter document have in a 1% by weight aqueous solution only a very weak tensio-activity which results in an air/water surface tension of about 50 mN/m (milli Newton per meter). Therefore these monomers have only a minor influence on the stability of the growing polymer.

While chain growth of the polymer results in the gradual incorporation of sufficient hydrophilic monomer to provide a self-dispersing effect, copolymer latices thereby obtained have a coarse grain size. Copolymerisation does not proceed completely when colour coupler monomers are used that are solid at room temperature (20° C.).

The present invention provides an aqueous highly stable dispersion of a copolymer (also called copolymer latex), the copolymer containing recurring units of a monomer which includes a photographically useful group, that plays a chemical role in the preparation, storage and/or processing of a photographic silver halide emulsion material or defines thereof at least partly the spectral absorption characteristics, and recurring units of an ionogenic surface active monomer, characterized in that the said ionogenic surface active monomer corresponds to the formula (A):

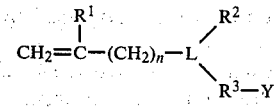

(A)

wherein:

$R^1$ is hydrogen or methyl, n is 0 or an integer from 1 to 20, preferably 0 or 1, L is a trivalent linking moiety selected from the group consisting of

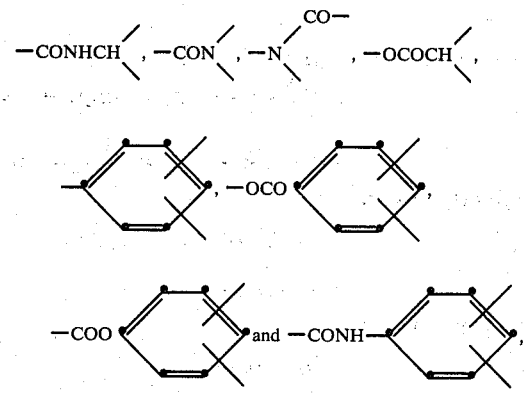

$R^2$ is a hydrogen atom or preferably an aliphatic branched or unbranched, saturated or unsaturated hydrocarbon group e.g. alkyl or alkenyl of 1 to 20 C-atoms, $R^3$ is a monovalent chemical bond or a bivalent aliphatic hydrocarbon group or such group interrupted by the group —COO— or —CONR— wherein R is hydrogen or $C_1$–$C_4$ alkyl; in particular $-(CH_2)_p-$ wherein p is an integer from 1 to 4, or $-(CH_2)_q-COO-(CH_2)_r-$ or $-(CH_2)_q-CONR-(CH_2)_r-$ wherein q is an integer from 1 to 20 and r is an integer from 1 to 4, and Y is a hydrophilic group selected from sulpho, sulphato and phosphono in acid or salt form e.g. an alkali metal salt, ammonium salt and organic onium salt thereof, and wherein at least one of the groups represented by $-(CH_2)_n-$, $R^2$ and $R^3$ is or contains a hydrocarbon chain of at least 8 C-atoms.

The stability of the copolymer latices according to the invention is ensured by the combined presence in the ionogenic comonomer of at least one long hydrophobic group containing at least 8 carbon atoms, and of a strong hydrophilic group formed by the sulfonic acid, sulfuric acid or phosphonic acid group or salt thereof. The particles in the latices according to the invention usually have an average diameter below 100 nm, in most cases substantially below 70 nm so that the latices are excellently compatible with coating compositions comprising hydrophilic colloids, such as gelatin. Layers applied from a mixture of the latices with gelatin coating compositions are completely clear and transparent after drying. Probably the average small diameter of the latex particles is due to a better micelle-formation.

Due to the presence of said ionogenic comonomer the activity of the photographically useful group in the other comonomer is markedly raised in aqueous processing which is clearly demonstrated in the formation of a dye image with a higher maximum density and improved photographic speed when using a comonomer with colour coupler group copolymerised with said ionogenic comonomer.

Representative examples of ionogenic monomers corresponding to the above general formula are the following:

1. $CH_2{=}CH{-}CO{-}NH{-}CH(\diagup (CH_2)_{7(8)}{-}CH_3)(\diagdown (CH_2)_{8(7)}{-}COO{-}(CH_2)_2{-}SO_3Na)$ 2. $CH_2{=}CH{-}CO{-}NH{-}CH(\diagup (CH_2)_{7(8)}{-}CH_3)(\diagdown (CH_2)_{8(7)}{-}COO{-}(CH_2)_4{-}SO_3Na)$ 3. $CH_2{=}CH{-}CH_2{-}N(\diagup CO{-}(CH_2)_7{-}CH{=}CH{-}(CH_2)_7{-}CH_3)(\diagdown (CH_2)_4{-}SO_3Na)$ 4. $CH_2{=}CH{-}CH_2{-}N(\diagup CO{-}(CH_2)_{16}{-}CH_3)(\diagdown (CH_2)_4{-}SO_3Na)$ 5. $CH_2{=}CH{-}CH_2{-}O{-}CO{-}CH(\diagup (CH_2)_{13}{-}CH_3)(\diagdown SO_3Na)$ 6. $CH_2{=}CH{-}CH_2{-}O{-}CO{-}CH(\diagup (CH_2)_{15}{-}CH_3)(\diagdown SO_3Na)$ 7. $CH_2{=}CH{-}CH_2{-}O{-}CO{-}CH(\diagup (CH_2)_{19}{-}CH_3)(\diagdown SO_3Na)$ 8. $CH_2{=}CH{-}(CH_2)_8{-}CO{-}N(\diagup CH_3)(\diagdown (CH_2)_2{-}SO_3Na)$ 9. $CH_2{=}C(CH_3){-}CO{-}N(\diagup (CH_2)_{11}{-}CH_3)(\diagdown (CH_2)_3{-}SO_3Na)$ 10. $CH_2{=}CH{-}CO{-}NH{-}CH(\diagup (CH_2)_{13}{-}CH_3)(\diagdown CH_2{-}SO_3Na)$ 11. $CH_2{=}C(CH_3){-}CO{-}NH{-}(CH_2)_{10}{-}CO{-}O{-}(CH_2)_4{-}SO_3Na$ -continued 12. $CH_2{=}CH{-}CO{-}NH{-}CH(\diagup (CH_2)_{7(8)}{-}CH_3)(\diagdown (CH_2)_{8(7)}{-}OSO_3Na)$ 13. $CH_2{=}C(CH_3){-}CONH{-}(CH_2)_{10}CONH(CH_2)_2SO_3Na$ The manufacture of the above ionogenic monomers is described in the following preparations.

Preparation 1

(a) 106 g of acrylonitrile were added dropwise with stirring to 245 g of sulfuric acid while keeping the temperature below 20° C. Then 141 g of oleic acid were added dropwise. Stirring was continued for 3 hours at about 30° C. whereafter the reaction mixture was allowed to stand overnight at room temperature. The black viscous oil which had been formed was then poured into ice water and was stirred for 8 hours during which the ice water was renewed several times. Upon drying by evaporation 172 g of acrylamidostearic acid corresponding to the following formula were obtained:

$$CH_2{=}CH{-}CO{-}NH{-}CH(\diagup (CH_2)_{7(8)}{-}CH_3)(\diagdown (CH_2)_{8(7)}{-}COOH)$$

The sodium salt of the acrylamidostearic acid was formed by adding an equivalent amount of sodium hydroxide dissolved in methanol, followed by freeze-drying.

(b) A mixture of 35.3 g of the above acrylamidostearic acid and 12.6 g of 2-hydroxyethane sulfonic acid in 500 ml of benzene was refluxed in a Dean and Stark apparatus for 24 h. Traces of m-dinitrobenzene and of hydroquinone were added as polymerization inhibitors. After cooling the benzene was decanted and the residue was dissolved in water and neutralised with 1 N sodium hydroxide, whereafter the solution was freeze-dried.

Yield: 45 g of ionogenic monomer no. 1.

Preparation 2

37.6 g of the sodium salt of acrylamidostearic acid (see Preparation 1), 20.4 g of butanesultone, 50 mg of hydroquinone and 50 mg of m-dinitrobenzene were dissolved in 100 ml of methanol. The solution was concentrated by evaporation, whereafter the mixture was filtered and dried under vacuum.

Yield: 40 g of ionogenic monomer no. 2.

Preparation 3

A solution of 57 g of allylamine and 136 g of butanesultone in 1 l of methanol was stirred for 48 h at room temperature. After evaporation, washing the residue with ether and drying under vacuum, 70 g of N-allyl-aminobutane sulfonic acid were obtained.

19.3 g of the N-allyl-aminobutane sulfonic acid and 4 g of sodium hydroxide were dissolved in 200 ml of water whereafter simultaneously 30.05 g of oleylchloride and 100 ml of 1 N sodium hydroxide were dropwise added under stirring.

After stirring for 1 h at room temperature the solution was freeze-dried. The product was washed with acetone and dried under vacuum.

Yield: 40 g of ionogenic monomer no. 3.

Preparation 4

The procedure of preparation 3 was repeated with the sole difference that the 30.05 g of oleylchloride were replaced by 30.25 g of stearylchloride.

Yield: 48 g of ionogenic monomer no. 4.

Preparation 5

250 g of stabilized sulfuric acid anhydride were added dropwise with stirring to a mixture of 500 g of palmitic acid and 1500 ml of dry chloroform. Thereby the temperature rised to about 45° C. and a dark coloured solution was formed. This solution was heated at the boiling temperature while stirring and was refluxed for 90 minutes. Thereafter the solution was cooled and placed in a refrigerator at −20° C. A precipitate formed that was sucked off and dried under vacuum.

Yield: 550 g of alpha-sulfopalmitic acid.

100 g of this alpha-sulfopalmitic acid, 500 ml of allyl alcohol, 100 mg of hydroquinone and 100 mg of m-dinitrobenzene were refluxed for 24 h. The dark solution was cooled and neutralised with 300 ml of 1 N sodium hydroxide in methanol. The solution was cooled in a refrigerator and the precipitate sucked off and dried under vacuum.

Yield: 109 g of ionogenic monomer no. 5.

Preparations 6 and 7

Preparation 5 was repeated but the palmitic acid was replaced by stearic acid and behenic acid respectively.

Yield: ionogenic monomers nos. 6 and 7.

Preparation 8

A mixture of 100 g of 10-hendecenoic acid, 250 ml of thionyl chloride and 1 ml of dimethylformamide was boiled for 3 h. Thereafter the thionylchloride was evaporated under vacuum and the residue was distilled.

Yield: 70 g of 10-hendecenoic acid chloride.

10.125 g of the above 10-hendecenoic acid chloride dissolved in 10 ml of acetone were dropwise added with stirring to a solution of 8.05 g of sodium-methyltauride and of 4.62 g of sodium hydrogen carbonate in 50 ml of water. Stirring was continued for 2 h at room temperature whereafter precipitation occurred in acetone. Drying under vacuum.

Yield: 10.3 g of ionogenic monomer no. 8.

Preparation 9

A solution of 185 g of dodecylamine and 122 g of propane sultone in 2 liter of xylene was refluxed for some hours and thereafter cooled in ice water. The precipitate was stirred in acetone, sucked off and dried under vacuum.

Yield: 300 g of product.

30.7 g of the above formed product was dissolved in 4 g of sodium hydroxide and 100 ml of water. After cooling in ice water 4 g of sodium hydroxide in 100 ml of water and 10.45 g of methacrylic acid chloride were simultaneously added dropwise, the stirring being continued for 30 minutes whereafter the clear solution formed was freeze-dried.

Yield: 36 g of ionogenic monomer no. 9.

Preparation 10

290 g of 1-hexadecene were dropwise added at −10° C. to a solution of 150 ml of acetic acid in 220 ml of methylene chloride, whereafter at the same temperature a solution of 100 g of stabilized sulfuric acid anhydride in 230 g of acetic acid were added under stirring. The reaction mixture was then stirred at room temperature for 2 hours, whereafter at 0° C. were consecutively and dropwise added: 15 ml of water, 137.8 g of acrylonitrile and 130 g of sulfuric acid. Stirring was continued for 48 hours at 40° C., followed by evaporation drying. The product obtained was dissolved in methanol, neutralised with 4 N sodium hydroxide in methanol, sucked off and crystallized from a mixture of 2 liter of alcohol and 400 ml of water.

Yield: 200 g of ionogenic monomer no. 10.

Preparation 11

100.5 g of 11-amino-hendecanoic acid were dissolved at 40° C. in a solution of 21 g of sodium hydroxide in 500 ml of water to which 250 mg of hydroquinone had been added as polymerisation inhibitor. Thereafter were added dropwise at the same temperature and simultaneously 52.25 g of methacryloyl chloride and a solution of 20 g of sodium hydroxide in 100 ml of water. As a result the temperature rose to 50° C.

Stirring was continued for about 30 min, thereby allowing the mixture to cool to room temperature. After washing with 1 l of water containing 2 N of hydrochloric acid the product was sucked off and dried under vacuum.

Yield: 117 g of 11-methacryloylamino-hendecanoic acid.

To form the sodium salt, the above carboxylic acid was dissolved in methanol, and there was added thereto an excess of sodium hydroxide dissolved in methanol.

Yield: 37 g of the soidum salt.

14.5 g of this sodium salt were introduced in a reaction vessel and 13.6 g of butanesultone and 200 ml of methanol were added. The mixture was refluxed for 16 hours, the solvent was evaporated under vacuum and the residue was thoroughly washed with acetone and thereafter sucked off and dried under vacuum.

Yield: 17 g of ionogenic monomer no. 11.

Preparation 12

The sodium salt of 9(10)-acrylamidostearyl sulphate was prepared as described in U.S. Pat. No. 3,640,922, Example 7.

Preparation 13

A mixture of 269 g of 11-methacryloylamino-hendecanoic acid (see preparation 11), 500 ml of thionyl chloride, 5 ml of dimethylformamide and 1 g of m-dinitrobenzene were stirred and heated to reach reflux temperature. Refluxing was continued for 1 h and the excess of thionyl chloride was removed by evaporation under reduced pressure. The residual product being 11-methacryloylamino-hendecanoyl chloride was used as such in the preparation of the monomer 13.

A solution of 28.8 g of 11-methacryloylamino-hendecanoyl chloride in acetone and 100 ml of 1 N aqueous sodium hydroxide were added dropwise through separate funnels but simultaneously and with stirring to a solution of 12.5 g of taurine in 100 ml of 1 N aqueous sodium hydroxide. After the dropwise addition the reaction mixture was stirred for another hour. The pH was kept at or above 7 by the use of additional 1 N sodium hydroxide solution if necessary. The temperature rose to about 35° C. Thereupon the reaction mixture was cooled and filtered. The monomer was separated by freeze-drying or by precipitation with acetone.

Yield: 35 g of ionogenic monomer 13.

The particle size of the emulsion copolymer formed depends on the content of ionogenic comonomer present in the copolymer. Polymer particles having an average diameter smaller than 100 nm, in most cases smaller than 70 nm, are obtained when the copolymer comprises between 2 and 10% by weight of the ionogenic comonomer.

The photographically useful group present in one of the said monomers is a group that plays a chemical role in the preparation, storage and/or processing of a photographic silver halide emulsion material, or defines thereof at least partly the spectral absorption characteristics.

For example such a group may function as a colour coupler, a competing coupler, a development accelerator e.g. benzyl-α-picolinium bromide, a foggant including hydrazines and hydrazides e.g. acetyl-phenylhydrazine, a developing agent e.g. a hydroquinone, a 1-phenyl-3-pyrazolidinone, ascorbic acid and the like, a fog-inhibiting compound e.g. a 1-phenyl-5-mercaptotetrazole, a development inhibitor releasing compound (DIR-compound), a bleaching-inhibitor-releasing compound (BIR-compound), a bleaching-activator-releasing compound (BAR-compound), a dye e.g. serving for filter purposes or an ultraviolet light absorbing compound.

In forming the copolymer latex according to the invention one or more monomers which include a photographically useful group, may be used.

The invention is particularly concerned with copolymer latices wherein the recurring units of the monomer which includes a photographically useful group are recurring units of a monomeric coupler which is capable of oxidatively coupling with colour developing agents to form dyes or colourless compounds i.e. units of a monomeric colour coupler and/or a monomeric competing coupler. Competing couplers are well-known couplers used in colour photography in those instances where oxidation products of colour developing agents should be rendered ineffective for preventing degradation of the image quality.

The ethylenically unsaturated photographic colour coupler monomers or competing coupler monomers used in the formation of copolymer latexes of the present invention are generally of the type represented by the following general formula (B):

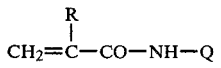

wherein:

R is hydrogen, a $C_1$–$C_4$ alkyl or chlorine,

Q is a colour coupler group or competing coupler group capable of oxidatively coupling with a colour developing compound, in particular an aromatic primary amino compound e.g. of the p-phenylene diamine type; in particular Q is a coupler group of the phenol or naphthol type, of the pyrazolone or indazolone type or of the acylacetamide type.

The colour coupler or competing coupler group Q may be e.a.

1. a group of a cyan-forming colour coupler of the phenol or naphthol type e.g. within the scope of the following general formula (I):

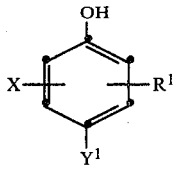

(I)

wherein:

X is a single chemical bond or a bivalent organic group linking the ethylenically unsaturated group of the formula (A) to the colour coupler group, $R^1$ represents hydrogen, a substituent of the type used in phenol or naphthol colour couplers e.g. halogen, alkyl or aryl, or the atoms necessary to complete a fused-on benzene nucleus, which may be substituted, and $Y^1$ represents a hydrogen atom in the case of 4-equivalent couplers or a substituent that splits off upon colour development, thus conferring to the colour coupler a 2-equivalent character for example a halogen atom e.g. chlorine, an acyloxy group, an alkoxy, aryloxy, or heterocycloxy group, an alkylthio, arylthio, or heterocyclic thio group e.g. a tetrazolylthio group or a phenylazo group.

2. a group of a magenta-forming colour coupler of the pyrazolone or indazolone type e.g. within the scope of the following general formula (II):

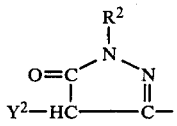

(II)

wherein:

$R^2$ is a substituent of the type used in the 1-position of 2-pyrazolin-5-one colour couplers e.g. alkyl or substituted alkyl e.g. haloalkyl such as fluoroalkyl, cyanoalkyl and benzyl, or aryl or substituted aryl e.g. phenyl, which may be substituted by alkyl, halogen, alkoxy, haloalkoxy, alkyl sulphonyl, haloalkyl sulphonyl, alkylthio, or haloalkylthio and $Y^2$ is hydrogen in the case of 4-equivalent couplers or a substituent that splits off upon colour development, thus conferring to the colour coupler a 2-equivalent character for example a halogen atom e.g. chlorine, an acyloxy group, an alkoxy group, an aryloxy group, or a heterocycloxy group, an alkylthio group, an arylthio group, or a heterocyclic thio group e.g. a tetrazolylthio or a phenylazo group.

3. a group of a yellow-forming colour coupler of the acylacetamide type, especially the acylacetanilide type e.g. an anilino-carbonylacetophenyl group or a benzoylacetamidophenyl group, wherein both aryl groups may be substituted by substituents well-known in yellow-forming colour couplers e.g. alkyl, alkoxy, halogen, alkylthio or alkylsulphonyl, and wherein the active methylene group may carry a substituent conferring to the colour coupler a 2-equivalent character for example a halogen atom e.g.

chlorine, acyloxy, an alkoxy, aryloxy, or heterocycloxy group, an alkylthio, arylthio or heterocyclic thio group.

4. a competing coupler group of the type wherein one hydrogen atom of an active methylene group is replaced by alkyl, preferably $C_1$–$C_4$ alkyl or substituted alkyl e.g. benzyl, preferably a competing coupler group of the 2-pyrazolin-5-one type.

Examples of monomeric colour couplers suitable for copolymerization to form a latex copolymer according to the present invention can be found e.g. in the Belgian Pat. Nos. 584,494; 602,516, and 669,971, in the United Kingdom Patent Specifications Nos. 967,503; 1,130,581; 1,247,688; 1,269,355; 1,363,230; and in the U.S. Pat. No. 3,356,686.

Representative examples of monomeric colour couplers and competing couplers are:

2-methylsulphonylamino-5-methacrylaminophenol,
2-methylsulphonylamino-4-chloro-5-methacrylaminophenol,
2-phenylsulphonylamino-5-methacrylaminophenol,
2-(4-chlorophenyl)sulphonylamino-5-methacrylaminophenol,
2-(4-sec.butylphenyl)sulphonylamino-5-methacrylaminophenol,
2-ethoxycarbonylamino-5-methacrylaminophenol,
2-n-butylureido-5-methacrylaminophenol,
2-benzoylamino-5-methacrylaminophenol,
2-o-methylbenzoylamino-5-methacrylaminophenol,
2-acetylamino-5-methacrylaminophenyl,
2-acetylamino-5-methacrylaminophenol,
2-p-methoxybenzoylamino-5-methacrylaminophenol,
2-o-chlorobenzoylamino-5-methacrylaminophenol,
2-p-t.butylbenzoylamino-5-methacrylaminophenol,
1-hydroxy-N-β-acrylamidoethyl-2-naphthamide,
1-hydroxy-N-β-vinyloxyethyl-2-naphthamide, 1-hydroxy-4-chloro-N-β-methacrylamidoethyl-2-naphthamide,
1-hydroxy-4-chloro-N-β-acrylamidoethyl-2-naphthamide,
2-methylacrylamido-4,6-dichloro-5-methylphenol,
1-benzyl-3-acrylamido-2-pyrazolin-5-one,
1-(2-cyanoethyl)-3-methacrylamido-2-pyrazolin-5-one,
1-(3,4-dichlorobenzyl)-3-methacrylamido-2-pyrazolin-5-one,
1-(2,2-trifluoroethyl)-3-methacrylamido-2-pyrazolin-5-one,
1-p-(1,1,2-trifluoro-2-chloroethoxy)-phenyl-3-methacrylamido-2-pyrazolin-5-one,
1-phenyl-3-methacrylamido-2-pyrazolin-5-one,
1-o-bromophenyl-3-methacrylamido-2-pyrazolin-5-one,
1-(2',4',6'-trichlorophenyl)-3-acrylamido-2-pyrazolin-5-one, p-methacrylamidobenzoylacetanilide,
3-methoxy-4-(o-methoxybenzoylacetylamino)-methacrylanilide, p-methacrylamido-benzoylacetaniside,
2-chloro-4-methacrylamido-benzoylacetanilide,
1-phenyl-3-methacrylamido-4-methyl-2-pyrazolin-5-one,
1-p-methylsulphonylphenyl-3-methacrylamido-4-methyl-2-pyrazolin-5-one,
1-(2-chloro-4-methylsulphonylphenyl)-3-methacrylamido-4-methyl-2-pyrazolin-5-one,
1-(2,4,6-trichlorophenyl)-3-methacrylamido-4-methyl-2-pyrazolin-5-one,
1-m-chlorophenyl-3-methacrylamido-4-methyl-2-pyrazolin-5-one.

The monomers including a photographically useful group which are used in the formation of a copolymer latex according to the present invention can further be monomers including a UV-absorbing moiety.

UV-absorbing hydrophobic compounds that can be transformed into ethylenically unsaturated monomers are e.g. of the type described in the U.S. Pat. Nos. 2,739,888; 3,468,897; 3,652,284; 3,687,671 and 3,706,700.

As referred to hereinbefore, the monomer including a photographically useful group can be a monomeric DIR-compound, BIR-compound, and BAR-compound formed from a known DIR-, BIR- and BAR-compound by introduction of an ethylenically unsaturated group. DIR-, BIR- and BAR-compounds are well known in the art and are compounds which by an elimination reaction during photographic processing release a development inhibitor, bleach inhibitor or bleach accelerator. These compounds include the well-known classes of couplers e.g. as referred to hereinbefore, which carry at their coupling position a group which upon being split off by reaction of the coupler with oxidized developing agent, forms a development inhibitor, bleach inhibitor or bleach accelerator.

Examples of DIR-compounds are described by Barr et al in Photographic Science and Engineering Vol. 13, no. 2, March-April 1969 p. 74–80, and ibidem no. 4, July-August 1969, p. 214–217, in the U.S. Pat. Nos. 3,148,062; 3,227,554; 3,617,291 and the published German Patent Application DE-OS 2,414,006. BIR-compounds are described e.g. in the U.S. Pat. Nos. 3,705,799 and 3,705,803 and the published German Patent Applications DE-OS No. 2,405,279; 2,412,078 and 2,412,610.

Other bleach inhibitor releasing compounds for use with silver halide emulsion layers are compounds releasing a bleach inhibitor upon alkaline development in the areas where the silver image is formed. Such compounds are described e.g. in the U.S. Pat. No. 3,705,801.

The BAR-compounds may be of the same type as described hereinbefore for the BIR-compounds with the difference that the image-wise releasable bleach inhibitor moiety is now a bleach accelerator moiety. In this connection there can be referred to Research Disclosure Oct. 1973, Disclosure no. 11449 and the published German Patent Application DE-OS No. 2,547,691.

By the present technique of incorporating photographically useful substances as a part of a latex particle they are rendered perfectly non-migratory i.e. their diffusion through a hydrophilic colloid medium is inhibited and consequently they remain in the photographic material at the site where they were originally incorporated when not chemically split off in the processing in a form free to diffuse.

The polymeric compounds e.g. couplers according to the present invention can be characterized by their so-called equivalent molecular weight. By equivalent molecular weight is understood the number of grams of polymer containing 1 mole of polymerized monomeric compound with photographically useful group e.g. monomeric coupler. It can be compared with the molecular weight of the non-polymeric classical non-migratory photographically useful compound e.g. coupler. The equivalent molecular weight of polymeric latex compounds according to the invention may vary within very wide limits, preferably from 200 to 2000.

The latices of the present invention can be prepared by emulsion polymerisation using a polymerisation initiator as described e.g. in the U.S. Pat. No. 3,926,436, Belgian Pat. No. 669,971 and United Kingdom Patent Specification No. 1,130,581.

Examples of polymerization initiators suitable for use in the above emulsion polymerisation process are e.g. persulphates such as ammonium and potassium persulphate, azonitrile compounds such as 4,4'-azo-bis(4-cyanovaleric acid) and likewise peroxide compounds e.g. benzoylperoxide.

The aqueous dispersion of the present polymer particles i.e. the latex of the present invention may contain optionally conventional emulsifiers although they can be omitted. If used, they can usually be employed in smaller proportion than is possible with known procedures where no monomeric surfactant in the copolymerisation is used.

The monomeric surfactants according to general formula (A) provides in a 1% by weight aqueous solution a tensio-activity which results in an air/water surface tension lower than 40 mN/m at 20° C.

In addition to the tensio-active repeating units and repeating units comprising a photographically useful group the latex polymer of the present invention may comprise and usually does comprise still other repeating units that are colourless and are chemically inert in the preparation, storage and processing of a photographic silver halide emulsion material. These repeating units are derived from a monomer or mixture of monomers providing particular physical characteristics to the latex e.g. improved thermal stability, and improved compatibility with photographic binders e.g. gelatin. Colourless ethylenically unsaturated monomers that are chemically inert in the sense as defined and that are copolymerisable with the monomers according to general formula (A) and the monomers containing a photographically useful group are e.g.: acrylic acid, methacrylic acid and esters and amides derived from these acids, α-chloroacrylic acid, α-alkacrylic acids, wherein the substituting alkyl contains from 1 to 4 carbon atoms e.g. methyl, ethyl, and n-propyl, the esters and amides derived from acrylic acid, α-chloroacrylic acid and these α-alkacrylic acids, such as acrylamide, methacrylamide, ethyl acrylate, n-butyl acrylate, 2-ethylhexyl acrylate and lauryl methacrylate, vinyl esters such as vinyl acetate, vinyl propionate, and vinyl laurate, acrylonitrile, methacrylonitrile, aromatic vinyl compounds and derivatives thereof such as styrene and its derivatives, e.g. vinyl toluene, vinyl acetophenone and sulphostyrene, itaconic acid, citraconic acid, crotonic acid, vinylidene chloride, vinyl alkyl ethers such as vinyl ethyl ether, maleic acid esters, N-vinyl-2-pyrrolidone, N-vinylpyridines e.g. 2- and 4-vinyl-pyridine and ethylenically unsaturated monomers such as 2-acetoacetoxyethylmethacrylate.

The latices containing the functional copolymer particles as specified above and prepared according to the known emulsion polymerization processes can be loaded with hydrophobic functional substances as described in the United Kingdom Patent Specifications Nos. 1,504,949 and 1,504,950 and the published German Patent Specification (DE-OS No. 2,835,856) e.g. accomplished by gradually adding the latex to a stirred solution of a hydrophobic substance to be loaded onto and/or into the latex particles in a water-miscible organic solvent or in a mixture of such solvents to such an extent that the hydrophobic substance becomes insoluble in the diluted solvent and optionally removing the organic solvent(s) at least partially from the latex. It is believed that during the addition of the aqueous latex to the solution of the hydrophobic substance in the water-miscible solvent, the solution gradually becomes more hydrophilic so that finally the hydrophobic substance leaves the dissolved state. At this very time many latex particles have been added already to the mixture, which particles start swelling in the water-miscible solvent and thus become receptive towards the hydrophobic substance in undissolved state in such a way that they absorb and/or adsorb the hydrophobic substance.

A great variety of hydrophobic organic functional substances can be loaded on the present latex copolymer particles. Hydrophobic substances suitable for loading are e.g. hydrophobic colour couplers, hydrophobic competing couplers, hydrophobic development-inhibitor-releasing compounds, hydrophobic UV-absorbing compounds, hydrophobic filter dyes, hydrophobic sensitizing agents, hydrophobic colour developing agents, hydrophobic black-and-white silver halide developing agents, hydrophobic development-activator-releasing compounds, hydrophobic bleaching-inhibitor-releasing compounds, hydrophobic optical brightening agents, hydrophobic anti-oxidizing agents, hydrophobic silver halide solvents, or hydrophobic dye-releasing agents and mixtures thereof.

The hydrophobic "loading" substances may have a function similar and consequently additive to that of the photographically useful units of the copolymer latex particles themselves. For instance, the copolymer latex particles may have recurring units with a colour coupler function and the loaded hydrophobic substance is a colour coupler as well, so that by the combined colour coupler action an increased colour density can be obtained.

Yet, the function of recurring units of the copolymer latex particles and the loaded hydrophobic substance may be different as well. For instance, the copolymer particles may comprise recurring units having a colour coupler function, whereas the loaded hydrophobic substance has e.g. a competing coupler function, a DIR-function, an UV-absorbing function, an anti-fogging function or developing function.

Suitable water-miscible organic solvents for hydrophobic substance to be loaded are acetone, methyl ethyl ketone, methanol, ethanol, isopropanol, tetrahydrofuran, dimethylsulfoxide, dimethylformamide, and N-methylpyrolidone. Mixtures of two or more of these solvents can be used likewise.

The following preparations I to IX illustrate how latexes of the present invention can be prepared.

Preparation I

Latex of the copolymer of N[1-phenyl-Δ2-pyrazolin-5-one-yl(3')]methacrylamide, butylacrylate and the sodium salt of N[2'-(sulphoethyl)octadecanoate-yl(10)]acrylamide having the following structural formula:

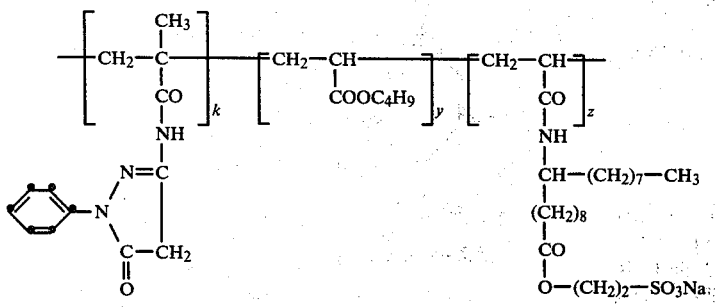

In a reaction flask provided with a thermometer, a reflux condensor and a dropping funnel 300 ml of demineralised water were heated to 95° C. Thereupon 10 ml of a solution of polymerisation initiator (1% by weight aqueous solution of the sodium salt of 4,4'-azobis(4-cyanovaleric acid) and one fifth by volume of an aqueous suspension in 200 m of demineralised water of 60 g of N[1-phenyl-Δ2-pyrazolin-5-one-yl(3')]methacrylamide (monomer B), 7 g of butylacrylate (monomer C) and 5 g of dissolved sodium salt of N[2'-(sulphoethyl)octadecanoate-yl(10)]acrylamide (monomer A) were added.

The reaction mixture was stirred and for a while the temperature dropped to 90° C. whereupon it rose again to 95°-96° C. after the polymerisation started. As soon as that temperature was reached an amount of initiator solution and another fifth of the above mixture of monomers (A), (B) and (C) as described above was introduced into the reaction flask. After a drop of the temperature to 90° C. heat was supplied to reach again 96° C. The above procedure of stepwise addition of initiator solution and monomers was repeated thrice again. After the last addition the contents of the reaction flask were heated for 45 min at reflux temperature. The obtained latex was cooled to 20° C. and filtered.

Yield: 570 ml of latex.

Concentration of the copolymer in the latex: 16.4 g per 100 ml. Equivalent molecular weight: 402. Average particle size: 75 nm.

Preparation II

Latex of the copolymer of N[1-phenyl-Δ2-pyrazolin-5-one-yl(3')]methacrylamide, butyl acrylate and the sodium salt of N-allyl, N-[4'-(sulphobutyl)]octadecanoylamide having the following structural formula:

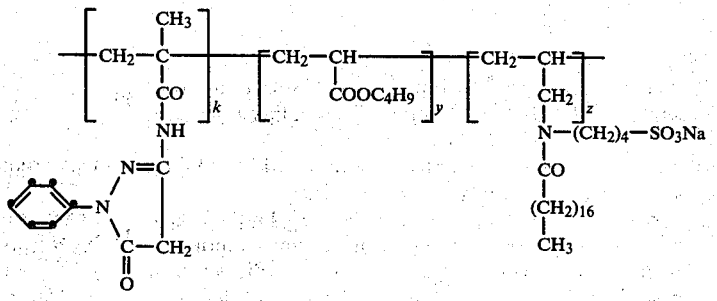

The preparation of the copolymer was carried out as described in Preparation I with the difference, however, that 5 g of the sodium salt of N-allyl, N[2'-(sulphobutyl)]octadecanoylamide were used instead of 5 g of monomer (A). Yield: 477 g of latex.

Concentration of the copolymer in the latex: 18.6 g per 100 ml. Equivalent molecular weight: 369. Average particle size: 72 nm.

Preparation III

Latex of the copolymer of N[1-phenyl-Δ2-pyrazolin-5-one-yl(3')]methacrylamide, butylacrylate and the sodium salt of α-sulphopalmitic acid allylester having the following structural formula:

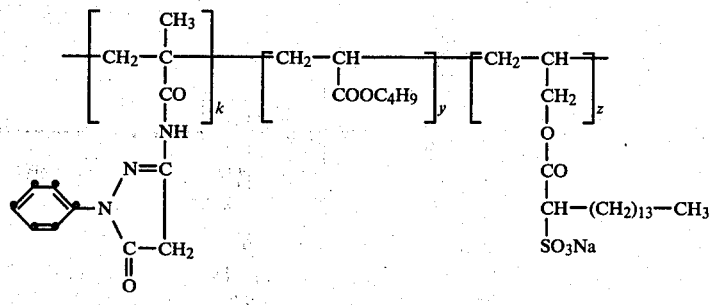

The preparation of the copolymer was carried out as described in Preparation I with the difference, however, that 5 g of the sodium salt of α-sulphopalmitic acid allylester were used instead of monomer (A).

Yield: 592 g of latex.

Concentration of the copolymer in the latex: 15.6 g per 100 ml.

Equivalent molecular weight: 392.

Average particle size: 79 nm.

Preparation IV

A. Latex of the copolymer of N{N'[1'(2,4,6-trichlorophenyl)-Δ2-pyrazolin-5-one-yl(3')]3-amino-4-chlorophenyl}methacrylamide, ethylacrylate and the sodium salt of α-sulpho-palmitic acid allyl ester having the following structural formula:

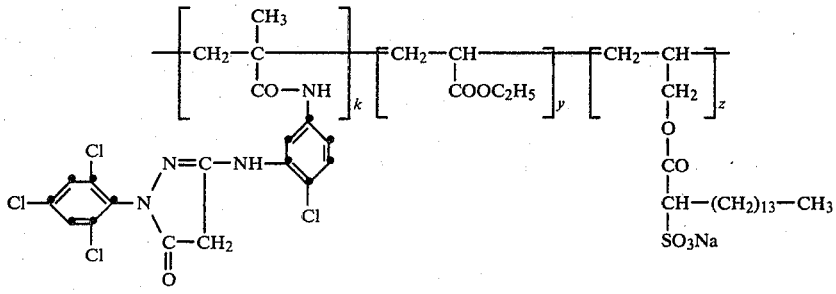

The preparation of the copolymer was carried out as described in Preparation I but using the following ingredients:

50 ml of a 1% by weight aqueous solution of the sodium salt of 4,4'-azobis(4-cyanovaleric acid), a monomer suspension of 40 g of N{N'[2,4,6-trichlorophenyl)-2-pyrazolin-5-one-yl(3')]3-amino-4-chlorophenyl}methacrylamide and 5 g of the sodium salt of α-sulphopalmitic acid allylester in 200 ml of demineralized water, 55 g of ethylacrylate.

Yield: 524 ml of latex.

Concentration of the copolymer in the latex: 17.5 g per 100 ml.

Equivalent molecular weight: 1174.

Average particle size: 59 nm.

B. N{3-N'[1'(2,4,6-trichlorophenyl)-Δ2-pyrazolin-5-one-yl(3')]-amino-4-chlorophenyl}methacrylamide having the following structural formula:

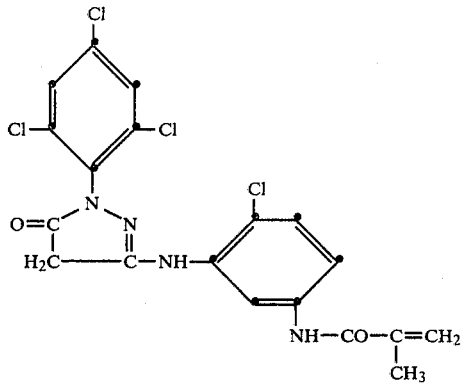

was prepared as follows 29.1 ml (0.30 mole) of methacrylic acid chloride were dropwise added to a suspension of 101 g (0.25 mole) of N{N'[(2,4,6-trichlorophenyl)-Δ2-pyrazolin-5-one-yl(3')]3-amino-4-chlorophenyl}methacrylamide and 42 g (0.50 mole) of sodium-hydrogen carbonate in 400 ml of dioxan.

Thereupon the yellow-brown suspension was stirred for 1 h and poured into 1 l of ice-water containing 30 ml of glacial acetic acid. The aqueous layer formed above the obtained oil was decanted. The oily product was stirred with 250 ml of acetonitrile till solidification as a grainy product.

Yield: 96 g. Melting point: 195 ° C. Recrystallisation from methylacetate gave 60 g of colour former having a melting point of 215° C.

Preparation V

Latex of the copolymer of N[3-hydroxy-4(1',1',2',2',3',3',3'-heptafluorobutyrylamino)phenyl]-methacrylamide, ethyl acrylate, methacrylic acid and the sodium salt of 2-acrylamido-hexadecane sulphonic acid having the following structural formula:

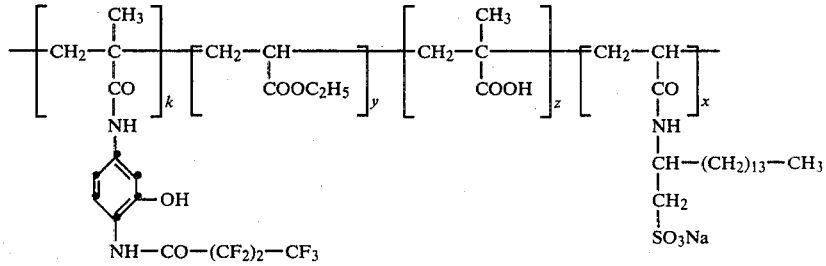

The preparation was carried out analogously to preparation I but using the following monomer mixture: 40 g of N[3-hydroxy-4(1',1',2',2',3',3',3'-heptafluorobutyrylamino)phenyl]methacrylamide, 5 g of the sodium salt of 2-acrylamido hexadecane sulphonic acid in 200 ml of demineralised water, 45 g of ethyl acrylate and 10 g of methacrylic acid, the latter two monomers being liquid at room temperature.

Yield: 554 ml of latex.

Concentration of the copolymer in the latex: 16.2 g per 100 ml.

Equivalent molecular weight: 756.

Average particle size: 59 nm.

Preparation VI

Latex of the copolymer of N[3(α-benzoylacetylamino)-4-methoxyphenyl]methacrylamide, ethylacrylate, methacrylic acid and the sodium salt of α-sulpho-palmitic acid allyl ester having the following general formula:

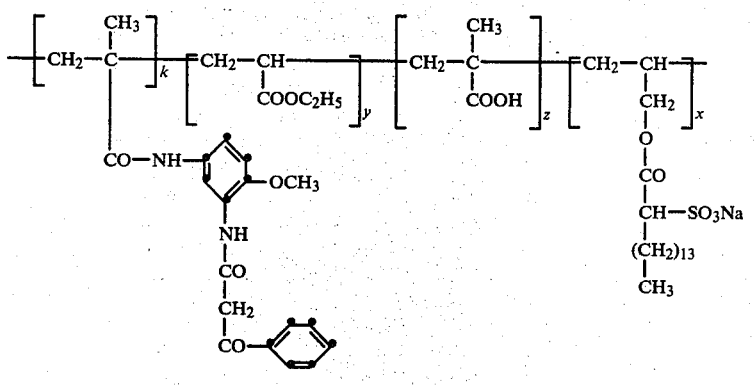

The preparation was carried out in the same way as described for preparation I but using the following ingredients:

50 ml of a 1% by weight aqueous solution of the sodium salt of 4,4'-azobis(4-cyanovaleric acid)

a suspension of 40 g of N[3(α-benzoylacetylamino)-5-methoxyphenyl]methacrylamide, 5 g of the sodium salt of α-sulphopalmitic acid allyl ester in 200 ml of dimineralised water, and a liquid monomer mixture of 30 g of ethyl acrylate and 25 g of methacrylic acid.

Yield: 532 ml of latex.

Concentration of the copolymer in the latex: 16.9 g per 100 ml.

Equivalent molecular weight: 811.

Average particle size: 60 nm.

Preparation VII

Latex of the copolymer of N[1-phenyl-4-methyl-2-pyrazolin-5-one-yl(3')]methacrylamide, butylacrylate and the sodium salt of α-sulphopalmitic acid allyl ester having the following structural formula:

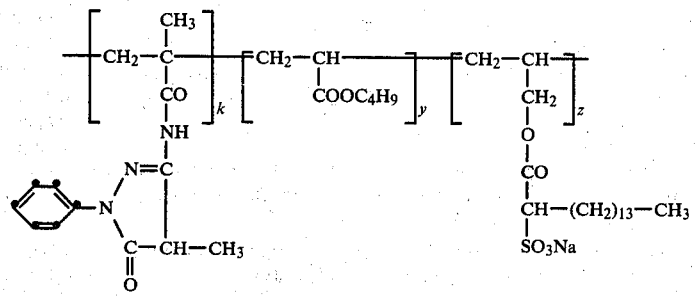

A suspension of 75 g of N[1-phenyl-4-methyl-2-pyrazolin-5-one-yl(3')]methacrylamide in 200 ml of demineralized water wherein 5 g of the sodium salt of α-sulphopalmitic acid allyl ester had been dissolved was heated up to 70° C. To the suspension 6 g of butylacrylate were added and heating continued to 90° C. Thereupon 12.5 ml of a 1% by weight aqueous polymerisation initiator solution of the sodium salt of 4,4'-azo-bis(4-cyanovaleric acid) were added and the temperature of 95° C. was attained.

Over a period of 20 min 14 g of butylacrylate and 47.5 ml of said polymerisation initiator were added and thereupon the reaction mixture was boiled at reflux temperature. The latex was freed from residual monomer by destillation under reduced pressure, cooled and filtered.

Yield: 356 ml of latex.

Concentration of the copolymer in the latex: 20 g per 100 ml.

Equivalent molecular weight: 334.

Average particle size: 80 nm.

Preparation VIII

Latex of the copolymer of N[3(1'-phenyltetrazolylthio)acetyl-phenyl]methacryloylamide, ethyl acrylate and the sodium salt of α-sulphopalmitic acid allyl ester having the following structural formula:

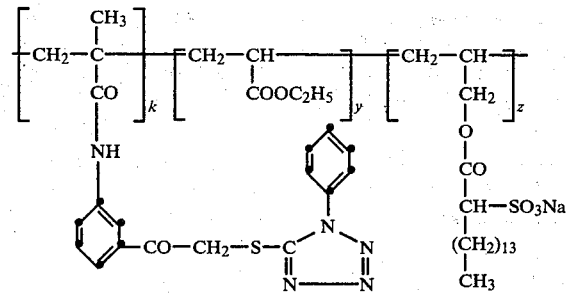

The preparation proceeded stepwise as exemplified in preparation I but using in each step the following ingredients:

50 ml of a 1% by weight aqueous solution of the sodium salt of 4,4'-azo-bis(4-cyanovaleric acid)

monomer suspension of 40 g of (1-phenyl-tetrazolyl-5-thio)-3-methacrylamido-acetophenone) in 200 ml of demineralised water wherein 5 g of the sodium salt of α-sulphopalmitic acid allyl ester have been dissolved, 55 g of ethylacrylate.

After the copolymerisation reaction the latex was concentrated by evaporation of some of the aqueous liquid.

Yield: 500 ml of latex.

Concentration of the copolymer in the latex: 18.2 g per 100 ml.

Equivalent molecular weight: 898.

Average particle size: 66 nm.

Preparation IX

Latex of the copolymer of N-[2-(2'-hydroxyphenyl)-benzotriazolyl(5')]methacrylamide, ethylacrylate and the sodium salt of α-sulphopalmitic acid allyl ester having the following structural formula:

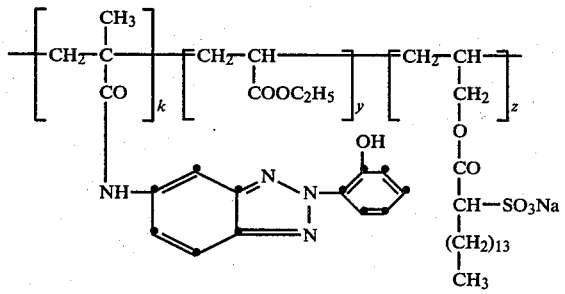

The preparation proceeded stepwise as exemplified in preparation I but using in each step the following ingredients:

50 ml of a 1% by weight aqueous solution of the sodium salt of 4,4'-azo bis(4-cyanovaleric acid), monomer suspension of 40 g of 2-(2'-hydroxyphenyl)-5-methacryloylamino-benzotriazole in 200 ml of demineralised water wherein 5 g of the sodium salt of α-sulphopalmitic acid allyl ester has been dissolved, 55 g of ethylacrylate.

After the copolymerisation reaction the latex was concentrated by evaporation of some of the aqueous liquid.

Yield: 464 ml of latex.

Concentration of the copolymer in the latex: 18.1 g per 100 ml.

Equivalent molecular weight: 708.

Average particle size: 47 nm.

The latices according to the invention may be incorporated in coating compositions for the manufacture of gelatin-containing layers of a photographic silver halide containing material. This layer may be a light-sensitive silver halide emulsion layer, or it may be a subbing layer, an antistress layer, an antihalation layer or any other auxiliary layer of the photographic element. The concentration of the latices may be adapted as desired. They are preferably prepared in such a way that the actual concentration of the copolymer in the latex is comprised between about 15 and 40% by weight. The copolymer latices are mixed homogeneously in the desired amount with the aqueous gelatin-containing coating composition before coating.

In the preparation of silver halide photographic materials according to the present invention various silver halides can be used as light-sensitive substance. For instance silver bromide, silver iodide, silver chloride or mixed silver halides such as silver chlorobromide, silver bromoiodide, and silver chlorobromoiodide can be employed.

The hydrophilic colloid used as the vehicle for the silver halide can be e.g. gelatin, colloidal albumin, zein, casein, a cellulose derivative, a synthetic hydrophilic colloid such as polyvinyl alcohol or poly-N-vinyl pyrrolidone. If desired, compatible mixture of two or more of these colloids can be employed for dispersing the silver halide.

The light-sensitive silver halide emulsions used in the preparation of a photographic material according to the present invention can be sensitized chemically as well as optically. They can be sensitized chemically by carrying out the ripening in the presence of small amounts of sulphur-containing compounds such as allyl thiocyanate, allyl thiourea, or sodium thiosulphate. The emulsions can also be sensitized by means of reducing agents e.g. tin compounds as described in the French Patent No. 1,146,955 and in Belgian Pat. No. 568,687, iminoaminomethane sulphinic acid compounds as described in United Kingdom Patent Specification No. 789,823 and small amounts of noble metal compounds such as gold, platinum, palladium, iridium, ruthenium, and rhodium compounds. They can be sensitized optically by means of organic sensitizing dyes known to those skilled in the art e.g. cyanine and merocyanine dyes.

The said emulsions can also comprise compounds that sensitize the emulsions by development acceleration e.g. compounds of the polyoxyalkylene type such as alkylene oxide condensation products as described i.a. in U.S. Pat. Nos. 2,531,832; 2,533,990, in United Kingdom Patent Specifications Nos. 920,637 - 940,051 - 945,340 - 991,608 and 1,091,705 and onium derivatives of amino-N-oxides as described in United Kingdom Patent Specification No. 1,121,696.

Further, the emulsions may comprise stabilizers e.g. heterocyclic nitrogen-containg thioxo compounds such as benzothiazoline-2-thione and 1-phenyl-2-tetrazoline-5-thione and compounds of the hydroxytriazolopyrimidine type. They can also be stabilized with mercury compounds such as the mercury compounds described in Belgian Pat. Nos. 524,121 - 677,337, and in the United Kingdom Patent Specification No. 1,173,609.

The light-sensitive silver halide photographic materials incorporating at least one of the present copolymer latexes may comprise also any other kind of substance known in the art as ingredient for photographic silver halide materials e.g. plasticizers, hardening agents and/or wetting agents and other ingredients described for the preparation and composition of photographic silver halide materials in Research Disclosure No. 17,643 of December 1978.

In connection with the hardening of gelatin-containing silver halide emulsion layers of photographic materials particularly good results have been obtained by applying to the emulsion layer an aqueous coating composition comprising a mixture of formaldehyde and phloroglucine which mixture provides rapid and reproducible hardening without problems in the keeping of the hardening mixture before coating.

The coating of the aqueous hardening mixture may proceed onto an already dry silver halide emulsion layer or in a cascade-coating system simultaneously with the silver halide emulsion coating composition. The concentration of applied hardening agents i.e. formaldehyde and phloroglucine depends on the gelatin content of the said colloid layer to be hardened and the thickness wherein the solution is applied. In a practically useful hardening agent solution the concentration of the formaldehyde is about 1 to 1.5% by weight and of the phloroglucine about 0.5% by weight. The total amount of applied hardening agents is normally in the range of 10 to 20 mmole of formaldehyde and 2 to 4 mmole of phloroglucinol per 100 g of gelatin.

For the preparation of a photographic multilayer colour material the non-diffusing colour couplers for each of the colour separation images are usually incorporated into the coating compositions of the differently sensitized silver halide emulsion layers. Yet, the non-diffusing colour couplers can also be added to the coating compositions of non-light-sensitive colloid layers that are in water-permeable relationship with the light-sensitive silver halide emulsion layers.

A photographic multilayer colour material usually comprises a support, a red-sensitized silver halide emulsion layer with a cyan-forming colour coupler, a green-sensitized silver halide emulsion layer with a magenta-forming colour coupler, and a blue-sensitive silver halide emulsion layer with a yellow-forming colour coupler.

During the preparation of a photographic colour material non-migrating latex colour couplers according to the present invention can be incorporated in the coating composition of the silver halide emulsion layers or other colloid layers in water-permeable relationship therewith. Before addition of the latex colour coupler to the coating composition for the formation of a layer e.g. silver halide emulsion layer of a photographic multilayer colour material, the latex colour coupler can first be loaded with further couplers as referred to hereinbefore.

Latex colour couplers according to the invention can be used in conjunction with various kinds of photographic emulsions. For example, the latex couplers can be used in emulsions of the mixed packet type as described in the U.S. Pat. No. 2,698,794 or emulsions of the mixed grain type as described in the U.S. Pat. No. 2,592,243 or they can be used with silver halide emulsions of any type described in Research Disclosure 17,643 of December 1978 e.g. silver halide emulsions wherein latent images are formed predominantly at the surface of the silver halide crystal or with emulsions wherein latent images are formed predominantly inside the silver halide crystal.

The silver halide emulsions can be coated on a wide variety of supports. Typical supports include cellulose ester film, polyvinylacetal film, polystyrene film, polyethylene terephthalate film and related films or resinous materials, as well as paper and glass.

For the production of photographic colour images with a photographic material comprising latex colour couplers according to the present invention the exposed silver halide is developed with an aromatic primary amino developing substance. All colour developing agents capable of forming azomethine dyes can be utilized as developers. Suitable developing agents are aromatic compounds such as p-phenylene diamines such as N,N-diethyl-p-phenylene diamine, N,N-dialkyl-N'-sulphomethyl-p-phenylene diamines and N,N-dialkyl-N'-carboxymethyl-p-phenylene diamines, and N,N-dialkyl-N'-carboxymethyl-p-phenylene diamines.

In photographic colour systems, according to which image dyes are formed by reaction of an image pattern of an oxidized p-phenylene diamine colour developing agent with a dye forming latex coupler according to the present invention, the developed metallic silver and residual silver salts are removed as a rule. This can be realized by separate bleaching and fixing steps, though processing is simplified by the use of a bath often called blix bath or bleach fix bath which bleaches and fixes in one single processing operation.

The following examples illustrate the present invention without, however, limiting it thereto. The ratios, parts and percentages are by weight unless otherwise indicated.

EXAMPLE 1

Test on dispersion stability.

The latexes prepared according to preparations I, II and III and the latex P prepared according to United Kingdom Patent Specification No. 1,453,057, preparation 3b, were subjected in a centrifuge operating at 20,000 rpm for 30 min to the same centrifugal force. The percentage of precipitate formed on the total content of solids of each latex was determined and is listed in the following table 1.

TABLE 1

| Latex | % of precipitate |
|---|---|
| I | 20 |
| II | 19 |
| III | 28 |
| P | 60 |

EXAMPLE 2

(a) Comparison material A 117 g of a silver bromoiodide emulsion (2.3 mole % of iodide) which comprises per kg an amount of silver halide equivalent to 47 g of silver nitrate and 73.4 g of gelatin, are diluted with 192.5 g of a 7.5% aqueous solution of gelatin and 100 g of distilled water. To the emulsion obtained are added with stirring 12 ml of the latex prepared according to preparation 3b of United Kingdom Patent Specification No. 1,453,057 which corresponds to 0.006 mole of polymerised monomeric colour coupler. After the addition of the common additives such as stabilizers, wetting agents and hardeners the necessary amount of distilled water is added to obtain 720 g.

The emulsion obtained is coated on a cellulose triacetate support pro rata of 125 g per sq.m. The emulsion layer is dried and overcoated with a gelatin antistress layer.

(b) Materials B, C and D

Material B, C and D were prepared in exactly the same way as material A except that instead of the latex prepared according to the said preparation 3(b) of United Kingdom Patent Specification No. 1,453,057 14.1 ml of latex prepared according to preparation I (material B), 14.1 ml of latex prepared according to preparation II (material C) and 15.1 ml of latex prepared according to preparation III (material D) were used.

The materials A to D were cut into strips and the resulting strips were exposed in a Herrnfeld sensitometer for 1/20th second through a continuous wedge with a constant of 0.30. The exposed strips were colour processed in the usual way, three different developers being used:

the first known as CD 2 developer, marketed by Eastman Kodak Company and containing as developing agent 2-amino-5-diethylamino-toluene hydrochloride; development time: 10 minutes; temperature of development: 24° C., the second developer known as CD 3 developer, marketed by Eastman Kodak Company and containing as developing agent 4-amino-N-ethyl-N-(β-methanesulphonamidoethyl)-m-toluidine sesquisulphate monohydrate; development time: 15 minutes; temperature of development: 21° C., and the third developer known as CD 4 developer, marketed by Eastman Kodak Company and containing as developing agent 4-amino-3-methyl-N-ethyl-N(β-hydroxyethyl)aniline sulphate; development time: 10 minutes; temperature of development: 25° C.

In table 2 hereinafter the values of speed, maximum gradient (γ) and maximum density (Dmax) obtained after development with the above-mentioned 3 developers of the strips of materials A to D are given. The values for the speed are relative values; a value of 100 is given to the speed for material A. The speed values were measured at optical density 0.2 above fog.

TABLE 2

| | CD 2 | | | CD 3 | | | CD 4 | | |
|---|---|---|---|---|---|---|---|---|---|
| Material | Speed | γ | $D_{max}$ | Speed | γ | $D_{max}$ | Speed | γ | $D_{max}$ |
| A | 100 | 1.6 | 2.2 | 100 | 1.5 | 2.5 | 100 | 1.5 | 2.3 |
| B | 200 | 1.8 | 2.8 | 158 | 1.8 | 2.7 | 200 | 1.9 | 2.8 |
| C | 126 | 1.9 | 2.7 | 126 | 1.9 | 2.6 | 158 | 1.7 | 2.5 |
| D | 126 | 1.8 | 2.7 | 158 | 1.8 | 2.8 | 158 | 1.9 | 2.6 |

We claim:

1. An aqueous dispersion of a copolymer comprising recurring units of a monomer which includes a photographically useful group, that plays a chemical role in the preparation, storage and/or processing of a photographic silver halide emulsion material, or defines thereof at least partly the spectral absorption characteristics, and recurring units of an ionogenic surface active monomer, characterized in that the said ionogenic monomer corresponds to the following general formula:

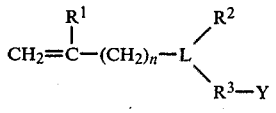

wherein $R^1$ is hydrogen or methyl, n is 0 or an integer from 1 to 20,

L is a trivalent linking moiety selected from the group consisting of —CONHCH<, —CON<,

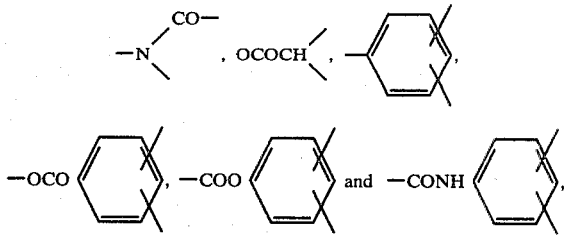

$R^2$ is hydrogen or an aliphatic branched or unbranched saturated or unsaturated hydrocarbon group, $R^3$ is a monovalent chemical bond or a bivalent aliphatic hydrocarbon group or such group interrupted by the group —COO— or —CONR— wherein R is hydrogen or a $C_1$–$C_4$ alkyl group, and Y is a hydrophilic group selected from sulpho, sulphato and phosphono in acid or salt form, and wherein at least one of the groups represented by $—(CH_2)_n—$, $R^2$ and $R^3$ is or contains an uninterrupted aliphatic hydrocarbon chain of at least 8 C-atoms, said monomer being present in said copolymer in an amount sufficient to contribute to the stability of the aqueous dispersion containing said copolymer and to provide a stable dispersion.

2. Aqueous dispersion according to claim 1, characterized in that $R^3$ represents $—(CH_2)_p—$ wherein p is an integer from 1 to 4, or $—(CH_2)_q—COO—(CH_2)_r—$ or $—(CH_2)_q—CONR—(CH_2)_r—$ wherein R is hydrogen or $C_1$–$C_4$ alkyl, q is an integer from 1 to 20 and r is an integer from 1 to 4.

3. Aqueous dispersion according to claim 1, characterized in that said ionogenic monomer provides in a 1% by weight aqueous solution, a tensioactivity which results in an air/water surface tension lower than 40 mN/m at 20° C.

4. An aqueous dispersion according to claim 1, characterized in that said photographically useful group functions as a color coupler, a competing colour coupler, a development accelerator, a foggant, a developing agent, a fog-inhibiting compound, a development inhibitor releasing compound, a bleaching-inhibitor-releasing compound, a bleaching-activator-releasing compound, a dye or an ultra-violet light absorbing compound.

5. An aqueous dispersion according to claim 4, characterized in that said monomer which includes a photographically useful group derived from a color coupler or competing colour coupler corresponds to the formula:

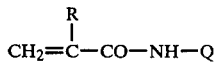

wherein:

R is hydrogen, a $C_1$–$C_4$ alkyl or chlorine,

Q is a color coupler or competing coupler group capable of oxidatively coupling with an aromatic primary amino compound.

6. An aqueous dispersion according to claim 5, characterized in that in said formula Q is a coupler group of the phenol or naphthol type, of the pyrazolone or indazolone type or of the acylacetamide type.

7. An aqueous dispersion according to claim 1, characterized in that the copolymer contains additionally a copolymerized monomer or mixture of monomers that is colourless and is chemically inert in the preparation, storage and processing of a photographic silver halide emulsion material.

8. An aqueous dispersion according to claim 7, characterized in that said monomer is selected from acrylic acid, methacrylic acid, esters and amides derived from these acids and aromatic vinyl compounds and derivatives thereof.

9. A photographic silver halide material comprising a support and at least one light-sensitive silver halide emulsion layer wherein said layer and/or a hydrophilic colloid layer in water-permeable relationship therewith comprises a copolymer incorporated therein from an aqueous dispersion of a copolymer comprising recurring units of a monomer which includes a photographically useful group, that plays a chemical role in the preparation, storage and/or processing of a photographic silver halide emulsion material, or defines thereof at least partly the spectral absorption characteristics, and recurring units of an ionogenic surface active monomer, characterized in that the said ionogenic monomer corresponds to the following general formula:

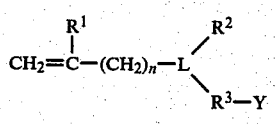

wherein:

$R^1$ is hydrogen or methyl, n is 0 or an integer from 1 to 20,

L is a trivalent linking moiety selected from the group consisting of —CONHCH<, —CON<,

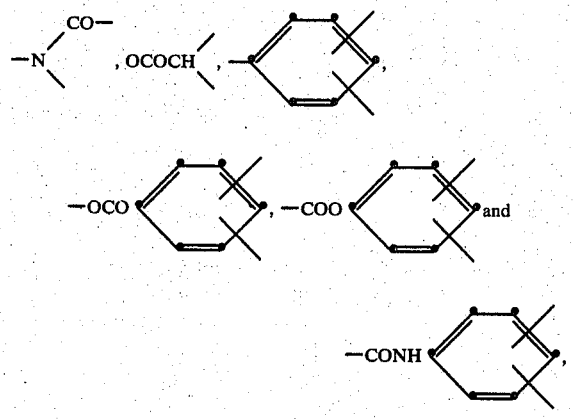

$R^2$ is hydrogen or an aliphatic branched or unbranched saturated or unsaturated hydrocarbon group, $R^3$ is a monovalent chemical bond or a bivalent aliphatic hydrocarbon group or such group interrupted by the group —COO— or —CONR— wherein R is hydrogen or a $C_1$–$C_4$ alkyl group, and Y is a hydrophilic group selected from sulpho, sulphato and phosphono in acid or salt form, and wherein at least one of the groups represented by $-(CH_2)_n-$, $R^2$ and $R^3$ is or contains a hydrocarbon chain of at least 8 C-atoms.

10. A photographic silver halide material according to claim 9, characterized in that said material contains said copolymer in a light-sensitive silver halide emulsion layer of a photographic multilayer colour material.

* * * * *